US006140974A

United States Patent [19]

Dalley

[11] Patent Number: 6,140,974

[45] Date of Patent: Oct. 31, 2000

[54] ANTENNA ARRANGEMENT

[75] Inventor: James Edward Dalley, Harlow, United Kingdom

[73] Assignee: Nortel Networks Limited, Montreal, Canada

[21] Appl. No.: 09/175,879

[22] Filed: Oct. 20, 1998

[51] Int. Cl.[7] ..... H01Q 9/26

[52] U.S. Cl. ..... 343/806; 343/803; 343/846

[58] Field of Search ..... 343/806, 833, 343/834, 835, 836, 829, 846, 848, 803, 810; H01Q 9/26

[56] References Cited

U.S. PATENT DOCUMENTS 3,409,893 11/1968 Siukola ..... 343/836

3,488,657 1/1970 Pressel et al. ..... 343/895

3,611,399 10/1971 Rocke ..... 343/834

*Primary Examiner*—Hoanganh Le

*Attorney, Agent, or Firm*—Lee, Mann, Smith, McWilliams, Sweeny & Ohlson

[57] ABSTRACT

The present invention provides an auxiliary or side lobe cancelling antenna particularly for horizontally polarised main antennas. The auxiliary antenna arrangement for cancelling side lobe interference from a main antenna comprises a ground plane shaped in a concertina or zig-zag fashion. Dipole pairs are spaced from and arranged perpendicular to the front bends, the dipoles having ends angled towards corresponding ground plane sections. The dipoles are connected anti-phase to provide a radiation pattern approximating an ideal auxiliary antenna mask of the main antennas pattern.

7 Claims, 5 Drawing Sheets

ANTENNA ARRANGEMENT

FIELD OF THE INVENTION

The present invention relates to antenna arrangements and is particularly but not exclusively related to auxiliary or side lobe cancelling antennas for horizontally polarised antenna arrangements.

BACKGROUND ART

In antenna applications such as fixed wireless access where suppression of all signals other than those in the main forward beam pattern or front lobe is desirable, auxiliary antennas are often used alongside the main antenna to enable the cancellation of side lobe interferers. The auxiliary antenna should ideally have a radiation pattern identical to the main antenna radiation pattern, but without the front lobe. By subtracting the auxiliary antenna signals from that of the main antenna, the resulting signals would then be from the main antenna's front lobe only, side lobe signals from the main antenna being cancelled by the auxiliary antenna signals.

As is known, auxiliary antennas approximating the radiation pattern or mask of a vertically polarised main antenna, minus the front lobe, can be created using a pair of vertically oriented dipoles connected in anti-phase. The two dipole radiation patterns interfere with one another to produce a pattern with relatively high gain at the side lobes and low gain in the front and reverse direction. This pattern can then be substructed from that of the main antenna to leave substantially only the main antenna front lobe To obtain a horizontally polarised side lobe canceller, this anti-phase dipole arrangement can be rotated by 90° to the horizontal. However this produces nulls at +/−90° to the front lobe, which severely limits this arrangement's ability to produce an approximation of the main antenna's radiation pattern less the front lobe.

U.S. Pat. No. 5,152,010 to Talwar discloses a two antenna system comprising an omni-directional main antenna and an auxiliary antenna. The auxiliary antenna of this system however provides only a rough approximation of the required main antenna side lobe pattern. The arrangement is also not well adapted for horizontally polarised main antennas.

OBJECT OF THE INVENTION

It is an object of the present invention to provide an improved auxiliary antenna arrangement for cancelling side lobe interference from a main antenna.

SUMMARY OF THE INVENTION

In a first aspect of the present invention there is provided an antenna arrangement comprising:

a pair of substantially co-planar dipoles each spaced from a folded ground plane comprising two forward bends, each bend being normal to said plane and adjacent the centre of the corresponding dipole; and wherein the ends of each dipole are arranged substantially parallel to a corresponding ground plane section.

Preferably the antenna arrangement further comprises one or more additional pairs of co-planar dipoles, wherein each dipole of said additional pair is substantially parallel with a corresponding dipole of said first pair, the ends of each additional dipole being arranged substantially parallel to a corresponding ground plane section.

Preferably the antenna arrangement further comprises one or more additional dipoles co-planar with said first dipole pair, the additional dipoles being spaced from a forward bend of the ground plane, each bend being normal to said plane and adjacent the centre of a corresponding additional dipole; and wherein the ends of each additional dipole are arranged substantially parallel to a corresponding ground plane section.

Preferably the antenna arrangement is an auxiliary antenna.

In a second aspect the present invention provides a method of operating an antenna arrangement comprising a pair of substantially co-planar dipoles each spaced from a folded ground plane comprising two forward bends, each bend being normal to said plane and adjacent the centre of the corresponding dipole; and wherein the ends of each dipole are arranged substantially parallel to a corresponding ground plane section; the method comprising the steps of:

operating the dipoles out of phase with respect to each other; and subtracting the signals received from said auxiliary antenna from those received from the main antenna.

Preferably said dipoles are operated substantially 180° out of phase such that said antenna arrangement operates as an auxiliary antenna.

Alternatively, said dipoles are operated less than 180° out of phase such that the forward gain of said antenna arrangement is dependent on the amount of phase difference between the dipoles.

In a third aspect the present invention provides an antenna arrangement comprising:

a dipole spaced from a folded ground plane comprising a forward bend being normal to the plane of the dipole and adjacent the centre of the dipole, and wherein the ends of the dipole are arranged substantially parallel to a corresponding ground plane section.

BRIEF DESCRIPTION OF THE DRAWINGS

In order that a greater understanding of the invention can be obtained, embodiments of the invention will now be described with reference to the accompanying drawings, by way of example only and without intending to be limiting, in which.

DETAILED DESCRIPTION

Figure 1:
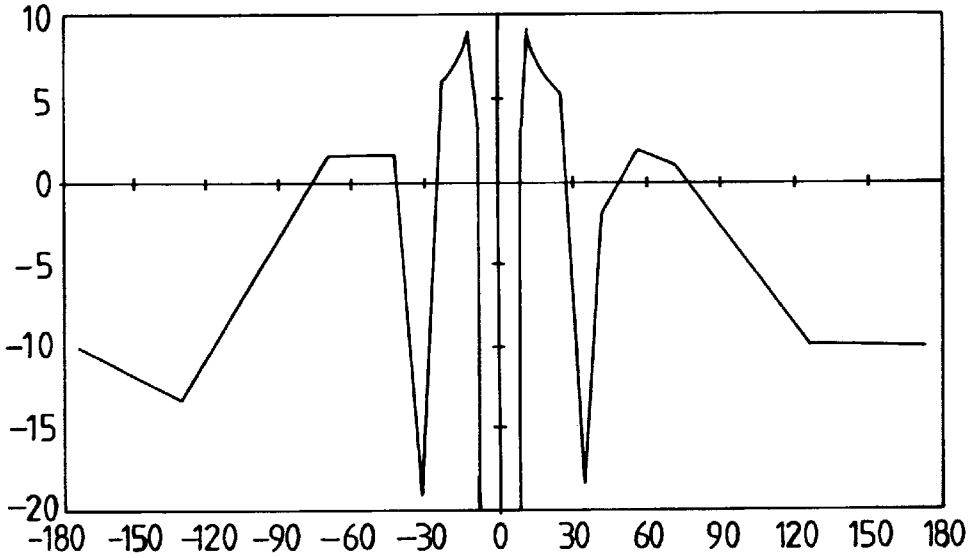
FIG. 1 shows a plot of gain versus azimuth scan angle for an ideal auxiliary antenna for a horizontally polarised hemispherical main antenna.

FIG. 1 shows the ideal gain versus azimuth scan angle plot for an auxiliary antenna radiation pattern corresponding to a horizontally polarised reflector main antenna. The auxiliary antennas radiation pattern or mask includes the main antenna side lobes as well as a null at around 0°, the main antennas front lobe position. By subtracting this auxiliary antenna mask or pattern from that of the main antenna, the main antenna side lobes are cancelled leaving only the front lobe as required.

Figure 2A:
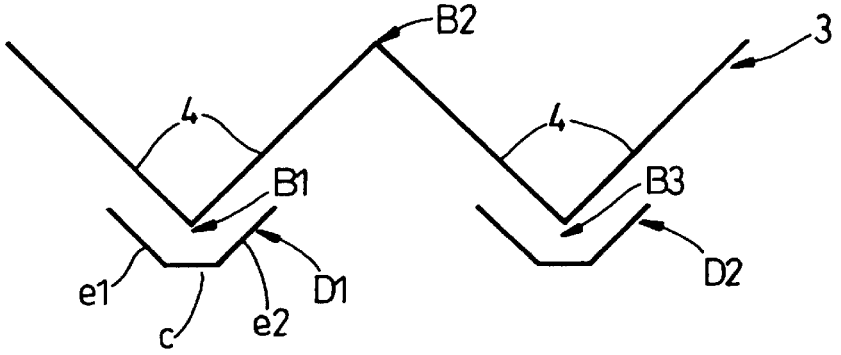
FIGS. 2*a, b,* and *c* show respectively plan, front elevation and side elevation views of a preferred embodiment auxiliary antenna.
Figure 2B:
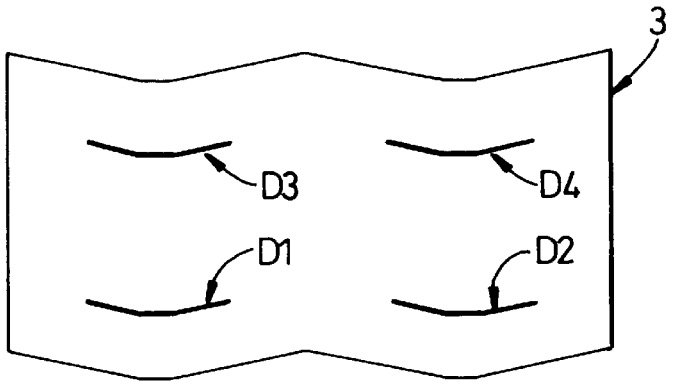
Figure 2C:
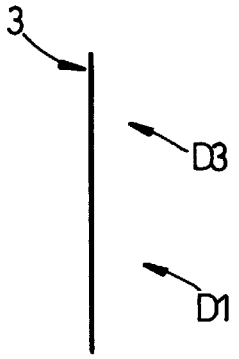

FIG. 2 shows plan, front elevation and side elevation views of a preferred embodiment auxiliary antenna of the invention. The auxiliary antenna 2 comprises a ground plane 3 and four dipoles D1, D2, D3 and D4. The ground plane 3 is folded into a series of sections, each section 4 of the folded ground plane 3 separated from an adjacent section by a bend B1–B3. The folded ground plane 3 is arranged in a concertina or zig-zag fashion as shown, such that the ground plane includes two forward bends B1 and B3, and one rearward bend B2; and such that the two end sections are tending rearward.

Alternatively, separate ground planes each comprising a single bend and two sections could be used for each dipole.

Preferably the ground plane sections are constructed of sheet metal, however spaced apart conducting wires or metal bars could also be used.

Preferably the ground plane 3 is symmetrical about the central and rearward bend B2. Preferably the sections 4 are of equal size, and the bends B are of 90°.

The dipoles D1, D2, D3 and D4 are arranged into horizontal pairs, each dipole of a pair spaced forward of a different forward bend B1 or B3 of the ground plane 3. The dipole pairs D1 and D2, or D3 and D4 are substantially co-planar and are spaced preferably an equal distance from the apex of a corresponding forward bend, B1 or B3. The longitudinal axes of the bends B1–B3 are preferably arranged perpendicular to the plane of the dipoles.

The dipoles D1–D4 each comprise a central portion c, with two end portions e1 and e2 bent towards the ground plane 3. The dipole ends e1 and e2 of each dipole are preferably angled such that they are parallel to a corresponding section 4 of the ground plane 3. In the preferred arrangement, the ground plane bends B1–B3 are of 90° each such that the end portions e1 and e2 of each dipole are bent from the dipole middle portion c by 45° towards the ground plane 3. The centre of the central portion C of each dipole corresponds to the apex of a forward bend B1 or B3.

The preferred antenna arrangement 2 comprises three bends B1–B3 and four sections 4; each bend B1–B3 is of 90°, and each section 4 is a half wavelength long (between bends B) such that the length from one end of the ground plane to the other is 1.4 wavelengths. The height of each section 4 is preferably one wavelength, and the dipoles D1–D4 are spaced a ¼ wavelength from the ground plane 3. Each dipole is a half wavelength long and is preferably arranged symmetrically about its centre, each portion c, e1 and e2 being preferably a third of its total length. The depth of the antenna arrangement 2 between the dipole middle portions c and the rear of the ground plane 3 (bend B2) is preferably 0.6 wavelengths. In the 2.30 to 2.50 GHz band, the overall size of the structure is 17.7 cm by 12.5 cm by 7.6 cm, which provides a conveniently compact arrangement.

The dipoles of each pair D1 and D2 or D3 and D4 are connected out of phase to produce a radiation pattern or mask with side lobes but with a reduced front lobe component. Preferably the dipoles of each pair are connected 180° out of phase to approximate the ideal auxiliary antenna mask shown in FIG. 1.

Figure 3:
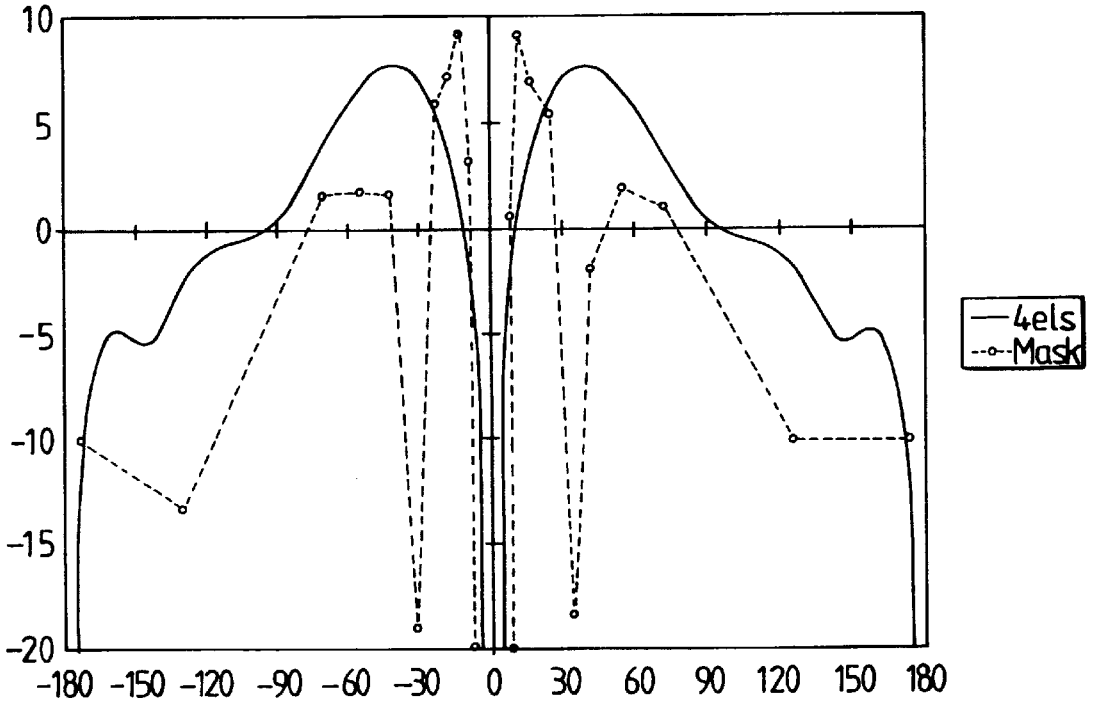
FIG. 3 shows a plot of gain versus azimuth scan angle for the preferred auxiliary antenna of FIG. 2.

The inventive antenna arrangement 2 described above forms an improved auxiliary antenna arrangement for horizontally polarised main reflector type antennas. The gain versus azimuth scan angle plot of this arrangement in the 2.30 to 2.50 GHz band can be seen in FIG. 3 compared with the ideal auxiliary antenna mask pattern of FIG. 1. It can be seen that unlike a standard straight dipole arrangement, there is no null at +/−90° which would otherwise adversely effect the side lobe cancelling performance of an auxiliary antenna.

The inventive auxiliary antenna arrangement 2 is described with reference to side lobe cancelling for a reflector main antenna. However with suitable modifications to the antenna dimensions and shape, the radiation pattern or mask of the auxiliary antenna can be altered to approximate the ideal auxiliary antenna pattern for other main antenna types. The auxiliary antenna arrangement 2 of the invention can therefore be applied to side lobe cancelling for various main antenna types.

As a further alternative the auxiliary antenna arrangement 2 could be rotated 90° to the vertical to provide an auxiliary antenna for a vertically polarised main antenna. This allows the use of the same apparatus for both vertical and horizontally polarised main antennas which simplifies the instalment of auxiliary antennas and reduces costs through economies of scale. This is particularly advantageous in for example fixed wireless access systems using vertical and horizontal polarisation in adjacent sectors or areas.

While the invention has been described as using two pairs of horizontally displaced dipoles D1 and D2, and D3 and D4, a single pair of horizontally displaced dipoles D1 and D2, or D3 and D4 could alternatively be used. Additional pairs of horizontally displaced dipoles can be stacked vertically added to improve the gain of the antenna and to narrow the vertical spread of the radiation pattern.

Figure 4A:
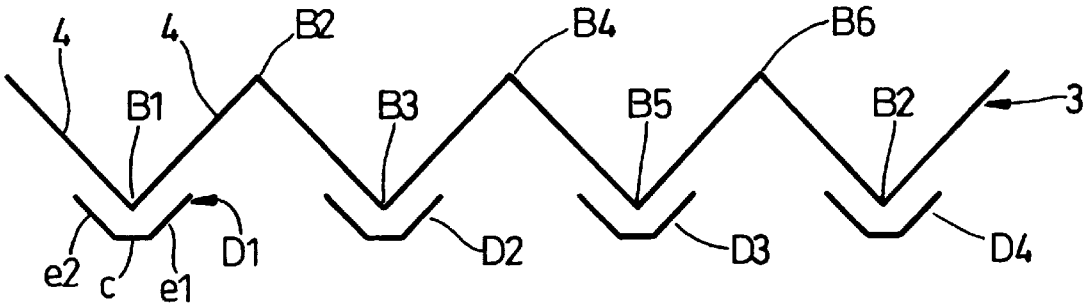
FIGS. 4*a, b* and *c* show respectively plan, front elevation and side elevation views of a second preferred embodiment auxiliary antenna.
Figure 4B:
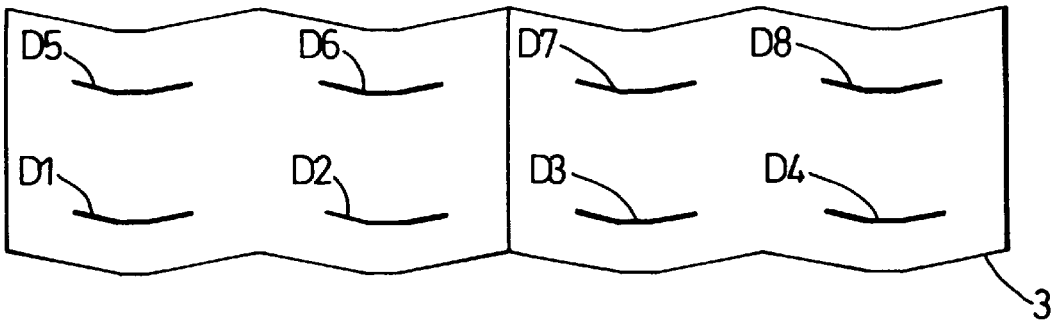
Figure 4C:
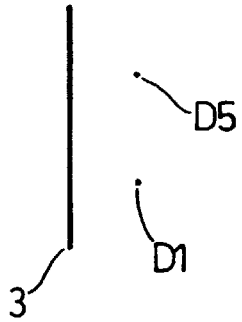

FIG. 4 shows a second preferred embodiment auxiliary antenna arrangement 20 which is analogous to the first embodiment but with four forward facing ground plane bends B1, B3, B5, B7, and eight dipoles D1, D2, D3, D4, D5, D6, D7 and D8. The dipoles are arranged into substantially coplanar sets of 4, each dipole of a set D1 or D5, D2 or D6, D3 or D7, D4 or D8, is spaced from a different forward facing bend respectively B1, B3, B5, B7.

As with the first embodiment, each dipole D1–D8 comprises a central portion c, with two end portions e1 and e2 bent towards the ground plane 3 such that they are substantially parallel with a corresponding ground plane section 4. The ground plane 3 is similarly folded in a concertina or zig-zag fashion and comprises eight sections 4. Preferably the ground plane 3 is symmetrical about the central rearward bend B4. Preferably the sections 4 are of equal size, and the bends are of 90°. Preferably the dipole sets are parallel and the dipoles are spaced an equal distance from the apexes of a corresponding forward bend B1, B3, B5 or B7. The longitudinal axes of the bends are preferably arranged perpendicular to the plane of the dipole sets.

The dipole ends e1 and e2 of each dipole are preferably angled such that they are parallel to the corresponding section 4 of the ground plane, being angled 45° towards the ground plane for the preferred 90° angle bend.

Preferably the dimensions of the second preferred embodiment correspond to those of the first preferred embodiment, the total length of the ground plane being 2.8 wavelengths.

As with the first preferred embodiment, a single set of 4 dipoles D1, D2, D3 and D4 or D5, D6, D7 and D8 can be used to create a side lobe cancelling radiation pattern or mask. Additional sets of dipoles in the vertical plane can be added to increase the gain of the auxiliary antenna and to improve the vertical directivity or reduce the vertical spread of the radiation pattern.

Figure 5:
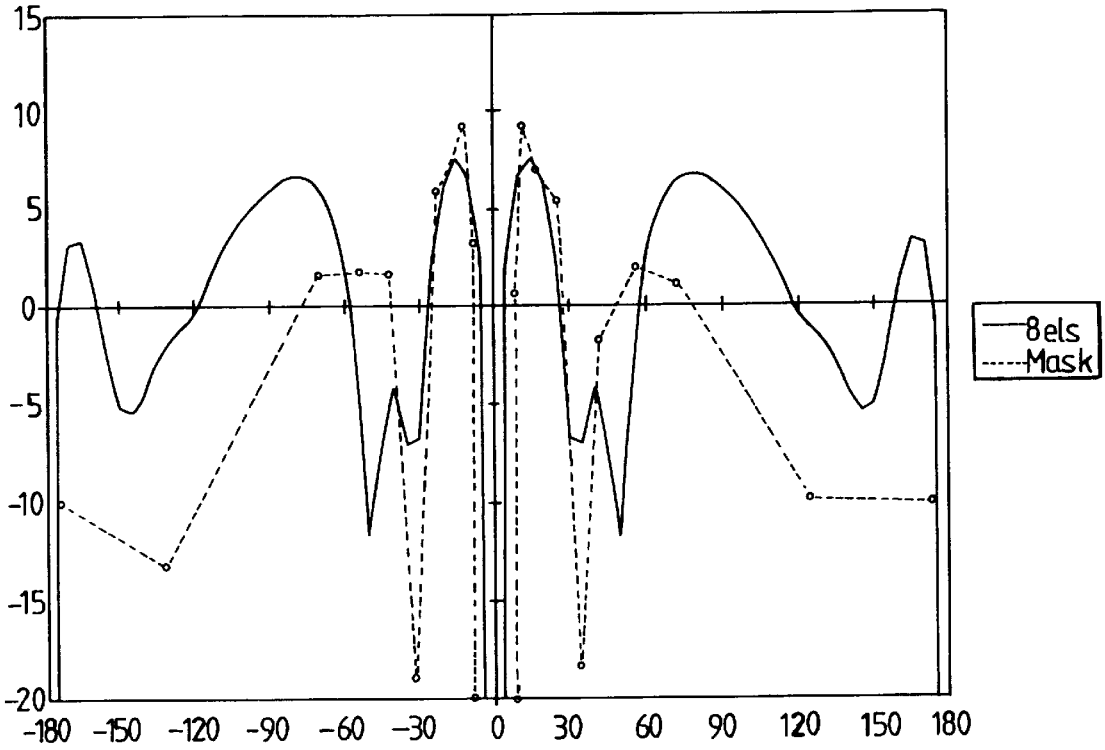
FIG. 5 shows a plot of gain versus azimuth scan angle for the second preferred auxiliary antenna of FIG. 4.

Looking at FIG. 4, the four left most dipoles D1, D2, D5 and D6 are connected in-phase, and the four right most dipoles D3, D4, D7 and D8 are connected out-of-phase to produce the gain versus azimuth scan angle or mask of FIG. 5. The use of four horizontal dipole sets provides an improved approximation of the ideal mask pattern.

Other combinations of both horizontally and vertically displaced dipoles could also be used. Similarly various amounts of phase displacement could also be employed to vary the radiation pattern or mask of the auxiliary antenna.

As with the first embodiment, varying various parameters such as the bend angle of the ground plane, the ground plane section 4 lengths, dipole lengths, dipole to ground plane distances, the characteristic of the gain versus scan angle plot of the auxiliary antenna arrangement can be varied. This can be used to tune the auxiliary antenna arrangement to other types of main antennas.

As a further alternative, the ground plane could be shaped into complimentary semi-circles, semi-circle dipoles being spaced from a forward curve of the ground plane, the dipoles being centred and aligned parallel with the ground plane at this point.

Figure 6:
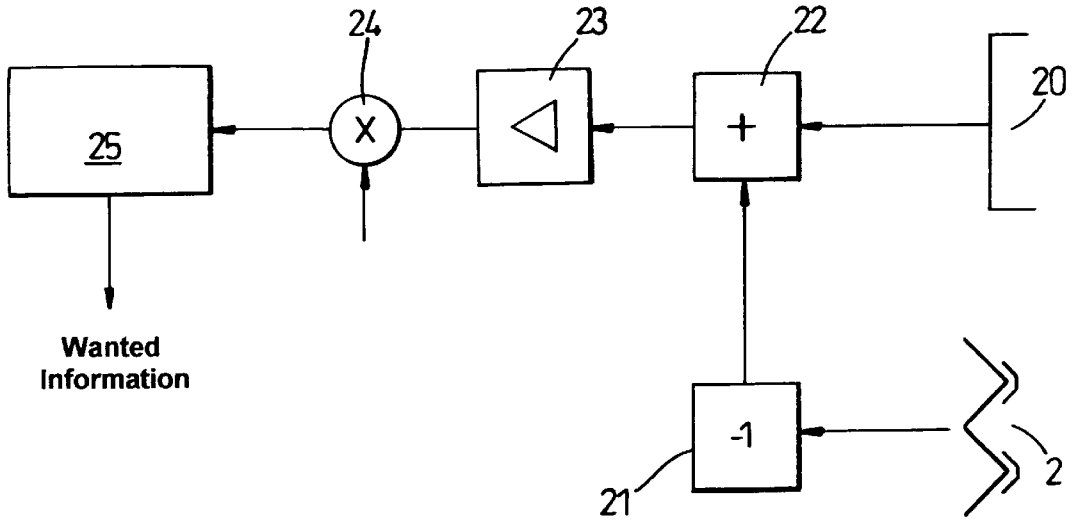
FIG. 6 shows an auxiliary antenna as shown in FIGS. 2*a–c* employed in a telecommunications arrangement.

FIG. 6 shows an auxiliary antenna 2 employed in a telecommunications arrangement such as a fixed wireless access receiver. The output from the auxiliary antenna 2 is inverted by an inverter 21 such as a unity gain inverting amplifier. This inverted output is then added to the output of the main antenna 20 by summer 22. This process effectively subtracts the auxiliary antenna signals from those of the main antenna 20 such that the signals past on to the amplifier 23 are substantially from the frontal lobe of the main antenna's radiation pattern. Subtraction of the auxiliary antenna signals substantially cancels the main antenna side lobe signals. The wanted signals are then down converted to an intermediate frequency by a down converter 24, and demodulated by a demodulator 25 to obtain the wanted information such as voice or data.

Figure 7:
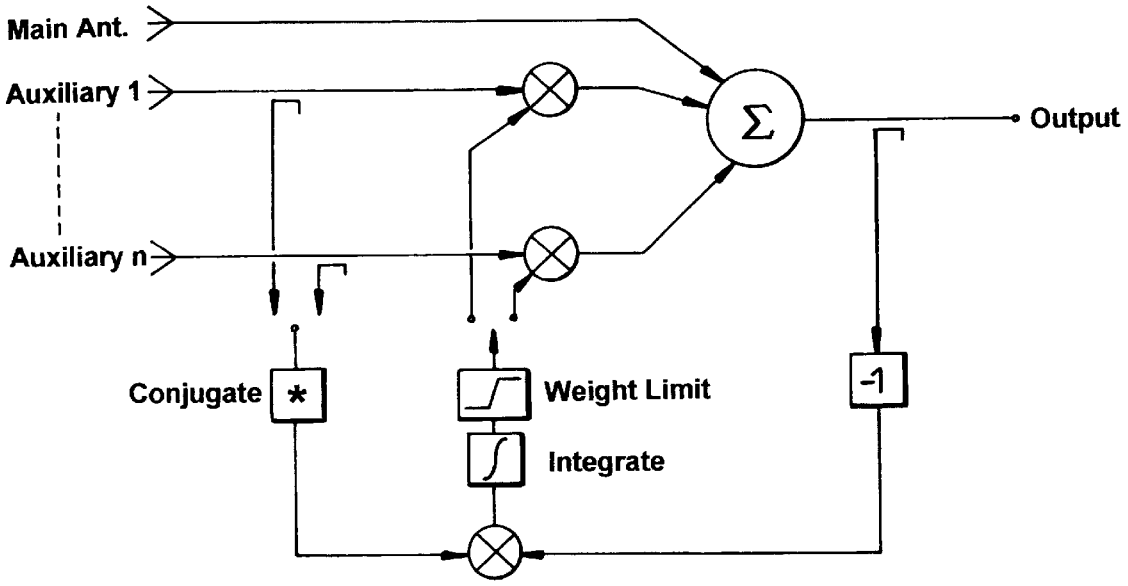
FIG. 7 shows a number of auxiliary antennas employed for side lobe cancellation of a main antenna.

More than one auxiliary antenna can be employed for side lobe cancellation of a main antenna as shown in FIG. 7. This is useful in adaptive antennas for example where the wanted signal direction varies implying the need to realign the net radiation pattern of the main antenna over time. Weighting factors are dynamically applied to one or more of the auxiliary antenna outputs before subtraction from the main antenna to achieve this.

In a further alternative, the weighting may be fixed, the combination of auxiliary antennas providing the desired radiation pattern or mask for subtraction from the, main antenna pattern to obtain wanted signals from the main antenna's frontal lobe.

In use, one or more auxiliary antenna arrangements 2 is (are) mounted adjacent the main antenna 20, and the auxiliary antennas received signals are subtracted from those of the main antenna effectively cancelling the main antenna's side lobes leaving substantially only signals received from the front lobe of its radiation pattern. This can be used for example in fixed wireless access systems which require a highly directional characteristic with strong cancellation of signals from other directions.

As a further alternative, in a transmission arrangement signals sent to a main antenna are also inverted and sent to an auxiliary antenna. The auxiliary antenna radiation pattern effectively cancels the side lobe transmission signals from the main antenna leaving substantially only signals in the main antenna's front lobe. This is useful in reducing the level of interference in adjacent cells for example.

The invention provides a cheap and compact auxiliary antenna arrangement which can form an important part of an interference reduction/side lobe cancellation system. The auxiliary antenna arrangement is readily adaptable for different main antenna arrangements. The preferred embodiment auxiliary antennas are both electrically small and provide radiation patterns which more closely match those of an ideal auxiliary antenna than prior art arrangements. One or more auxiliary antennas can be used with the main antenna to improve side lobe cancelling.

As a further alternative, the folded ground plane and corresponding dipole combination could be used as a standard horizontally polarised antenna with an improved radiation pattern. In this arrangement the antenna comprises a ground plane with a single forward bend and two sections 4, and one or more dipoles D spaced from the single vertically aligned bend. The dipoles comprise a central portion c and two end portions e1 and e2, the end portions are arranged substantially parallel with a corresponding section of the ground plane. This arrangement spreads the frontal lobe part of the radiation pattern further towards the side lobes which is useful in broadening antenna coverage in azimuth for example.

As a still further alternative, a horizontally polarised antenna can be contracted with the ground plane with two forward bends and horizontally displaced dipoles as described above in connection with the auxiliary antenna implementation of the invention. Instead of the dipoles being connected substantially 180° out of phase however, the dipoles are connected only slightly out of phase to form a horizontally polarised antenna in which the forward gain of the antenna can be controlled by shifting the dipoles further out of phase. This can be important to limit interference with an adjacent cell, particularly where the antenna has a clear line of sight with the cell.

The foregoing describes the invention including preferred forms thereof. Alternations and modifications as will be obvious to those skilled in the art are intended to be incorporated within the scope hereof.

What is claimed is:

1. An antenna arrangement comprising:

a pair of substantially co-planar dipoles each spaced from a folded ground plane comprising two forward bends, each bend being normal to said folded ground plane of said dipole pair and adjacent the centre of one of the dipoles; and wherein the ends of each dipole are arranged substantially parallel to a corresponding section of the ground plane.

2. An antenna arrangement as claimed in claim 1 further comprising one or more additional pairs of co-planar dipoles, wherein each dipole of said additional pair is substantially parallel with a corresponding dipole of said first pair, the ends of each additional dipole being arranged substantially parallel to a corresponding section of the ground plane.

3. An antenna arrangement as claimed in claim 1 further comprising one or more additional dipoles co-planar with said first dipole pair, the additional dipoles being spaced from a forward bend of the ground plane, each bend being normal to said plane and adjacent the centre of a corresponding additional dipole; and wherein the ends of each additional dipole are arranged substantially parallel to a corresponding section of the ground plane.

4. An antenna arrangement as claimed in claim 1, wherein the antenna arrangement is an auxiliary antenna.

5. A method of operating an antenna arrangement comprising a pair of substantially co-planar dipoles each spaced from a folded ground plane comprising two forward bends, each bend being normal to said folded ground plane of said dipole pair and adjacent the centre of one of the dipoles; and wherein the ends of each dipole are arranged substantially parallel to a corresponding section of the ground plane [section]; the method comprising the steps of:

operating the dipoles out of phase with respect to each other; and subtracting the signals received from said antenna arrangement from those received from a main antenna.

6. A method as claimed in claim 5, wherein said dipoles are operated substantially 180° out of phase such that said antenna arrangement operates as an auxiliary antenna.

7. A method as claimed in claim 5, wherein said dipoles are operated less than 180° out of phase such that the forward gain of said antenna arrangement is dependent on the amount of phase difference between the dipoles.

* * * * *